US010980700B2

(12) United States Patent
Lee et al.

(10) Patent No.: US 10,980,700 B2
(45) **Date of Patent: *Apr. 20, 2021**

(54) DRIVING MODULE, MOTION ASSISTANCE APPARATUS INCLUDING THE DRIVING MODULE, AND METHOD OF CONTROLLING THE MOTION ASSISTANCE APPARATUS

(71) Applicant: Samsung Electronics Co., Ltd., Suwon-si (KR)

(72) Inventors: Jongwon Lee, Uiwang-si (KR); Jeonghun Kim, Hwaseong-si (KR); Se-Gon Roh, Suwon-si (KR); Minhyung Lee, Anyang-si (KR); Youn Baek Lee, Yongin-si (KR); Byungjune Choi, Gunpo-si (KR); Hyun Do Choi, Yongin-si (KR)

(73) Assignee: Samsung Electronics Co., Ltd., Gyeonggi-do (KR)

( * ) Notice: Subject to any disclaimer, the term of this patent is extended or adjusted under 35 U.S.C. 154(b) by 275 days.

This patent is subject to a terminal disclaimer.

(21) Appl. No.: 16/160,116

(22) Filed: Oct. 15, 2018

(65) Prior Publication Data

US 2019/0046387 A1 Feb. 14, 2019

Related U.S. Application Data

(63) Continuation of application No. 14/597,632, filed on Jan. 15, 2015, now Pat. No. 10,137,049.

(30) Foreign Application Priority Data

Oct. 20, 2014 (KR) ..... 10-2014-0141621

(51) Int. Cl.
*A61H 3/00* (2006.01)
*A61H 1/02* (2006.01)

(52) U.S. Cl.
CPC ..... *A61H 3/00* (2013.01); *A61H 1/0244* (2013.01); *A61H 2003/007* (2013.01);
(Continued)

(58) Field of Classification Search
CPC ..... A61H 3/00; A61H 2003/001; A61H 2003/007; A61H 2201/0173–018;
(Continued)

(56) References Cited

U.S. PATENT DOCUMENTS 8,313,448 B2 11/2012 Shimada et al.
2003/0036462 A1 2/2003 Ravikumar et al.
(Continued)

FOREIGN PATENT DOCUMENTS

JP 1994114089 4/1994
JP 1999042259 2/1999
(Continued)

OTHER PUBLICATIONS

Korean Office Action dated Aug. 29, 2019 issued in corresponding Korean Application No. 10-2014-0141621.

*Primary Examiner* — Rachel T Sippel
(74) *Attorney, Agent, or Firm* — Harness, Dickey & Pierce, P.L.C.

(57) ABSTRACT

A driving module and a motion assistance apparatus including the same may be provided. For example, the driving module including a driving source disposed on one side of a user, and configured to provide power, a first decelerator including a first input terminal coupled to the driving source, and a first output terminal and a second output terminal configured to receive power from the first input terminal, a second decelerator including a second input terminal coupled to the first output terminal, and a third output terminal and a fourth output terminal configured to receive power from the second input terminal, and a third decelera-
(Continued)

tor including a third input terminal coupled to the second output terminal, and a fifth output terminal and a sixth output terminal configured to receive power from the third input terminal may be provided.

19 Claims, 11 Drawing Sheets

(52) U.S. Cl.
CPC ..... *A61H 2201/1472* (2013.01); *A61H 2201/165* (2013.01); *A61H 2201/5007* (2013.01)

(58) Field of Classification Search
CPC ..... A61H 2201/0192–0196; A61H 2201/12–1246; A61H 2201/1463–1472; A61H 2201/1481–149; A61H 2201/164; A61H 2201/1642; A61H 2201/1671–1673; A61H 2201/5007; A63B 23/04; A63B 23/0494; A61F 5/0102; A61F 5/0123–0125; A61F 2005/0137–0139; A61F 2005/0155; A61F 2005/0158; A61F 2005/0165
See application file for complete search history.

(56) References Cited

U.S. PATENT DOCUMENTS

| | | | |
|---|---|---|---|
| 2006/0142105 | A1 | 6/2006 | Kudoh et al. |
| 2015/0025423 | A1 | 1/2015 | Caires et al. |
| 2015/0257903 | A1 | 9/2015 | Perry et al. |

FOREIGN PATENT DOCUMENTS

| | | | |
|---|---|---|---|
| JP | 2004-089375 | A | 3/2004 |
| JP | 2006-075254 | A | 3/2006 |
| JP | 2011193901 | A | 10/2011 |
| JP | 2014073199 | A | 4/2014 |
| KR | 101304086 | B1 | 9/2013 |
| KR | 10-2013-0111763 | | 10/2013 |

DRIVING MODULE, MOTION ASSISTANCE APPARATUS INCLUDING THE DRIVING MODULE, AND METHOD OF CONTROLLING THE MOTION ASSISTANCE APPARATUS

CROSS-REFERENCE TO RELATED APPLICATION

This application is a continuation of U.S. application Ser. No. 14/597,632, filed on Jan. 15, 2015, which claims priority under 35 U.S.C. § 119 to Korean Patent Application No. 10-2014-0141621, filed on Oct. 20, 2014, in the Korean Intellectual Property Office, the entire contents of each of which are incorporated herein by reference.

BACKGROUND

1. Field

Example embodiments relate to driving modules, motion assistance apparatuses including the driving modules, and/or methods of controlling the motion assistance apparatuses.

2. Description of the Related Art

With the onset of rapidly aging societies, many people are experiencing inconvenience and/or pain from joint problems, and interest in motion assistance apparatuses, which enable the elderly or patients with joint problems to walk with less effort, is growing. Furthermore, motion assistance apparatuses for intensifying muscular strength of human bodies may be useful for military purposes.

In general, motion assistance apparatuses for assisting motion of lower parts of bodies may include body frames disposed on trunks of users, pelvic frames coupled to lower sides of the body frames to cover pelvises of the users, femoral frames disposed on thighs of the users, sural frames disposed on calves of the users, and pedial frames disposed on feet of the users. The pelvic frames and the femoral frames may be connected rotatably by hip joint portions, the femoral frames and the sural frames may be connected rotatably by knee joint portions, and the sural frames and the pedial frames may be connected rotatably by ankle joint portions.

The motion assistance apparatuses may include active joint structures including hydraulic systems and/or driving motors to drive each joint portion to improve muscular strength of legs of the users. For example, two individual motors to transmit driving power may be provided at left and right hip joint portions, respectively.

SUMMARY

Some example embodiments relate to a driving module.

According to an example embodiment, the driving module includes a driving source disposed on one side of a user, and configured to provide power, a first decelerator including a first input terminal coupled to the driving source, and a first output terminal and a second output terminal configured to receive power from the first input terminal, a second decelerator including a second input terminal coupled to the first output terminal, and a third output terminal and a fourth output terminal configured to receive power from the second input terminal, and a third decelerator including a third input terminal coupled to the second output terminal, and a fifth output terminal and a sixth output terminal configured to receive power from the third input terminal.

According to some example embodiments, the first decelerator may further include a first power transmitting rotary body configured to transmit power from the first input terminal to the first output terminal and the second output terminal, the second decelerator may further include a second power transmitting rotary body configured to transmit power from the second input terminal to the third output terminal and the fourth output terminal, and the third decelerator may further include a third power transmitting rotary body configured to transmit power from the third input terminal to the fifth output terminal and the sixth output terminal.

According to some example embodiments, the driving module may further include a first restrainer configured to selectively restrain the first output terminal, a second restrainer configured to selectively restrain the third output terminal, a third restrainer configured to selectively restrain the second output terminal, and a fourth restrainer configured to selectively restrain the sixth output terminal.

According to some example embodiments, the first restrainer and the second restrainer may be provided in an integral body, and the third restrainer and the fourth restrainer may be provided in an integral body.

According to some example embodiments, the driving module may further include a first stopper configured to selectively restrain one of the first output terminal and the third output terminal, and a second stopper configured to selectively restrain one of the second output terminal and the sixth output terminal.

According to some example embodiments, at least one of the first decelerator, the second decelerator, and the third decelerator may be a planetary gear type using a sun gear as the corresponding input terminal, and using a carrier and a ring gear as the corresponding two output terminals.

According to some example embodiments, at least one of the first decelerator, the second decelerator, and the third decelerator may be a type that transmits power by rolling friction using three pulleys as the corresponding input terminal and the corresponding two output terminals.

According to some example embodiments, at least one of the first decelerator, the second decelerator, and the third decelerator may be a harmonic drive type using a wave generator as the corresponding input terminal, and using a flexspline and a circular spline as the corresponding two output terminals.

Some example embodiments relate to a motion assistance apparatus.

According to an example embodiment, the motion assistance apparatus includes a fixing member to be attached to a user, a driving module disposed on one side of the fixing member, the driving module including a driving source, a first decelerator configured to receive power from the driving source, and a second decelerator and a third decelerator configured to receive power from the first decelerator, a first joint member and a second joint member configured to assist rotary motions of one portion and another portion of the user, respectively, a first power transmitting member configured to transmit power between an output terminal of the second decelerator and the first joint member, and a second power transmitting member configured to transmit power between an output terminal of the third decelerator and the second joint member.

According to some example embodiments, the first decelerator may include a first input terminal configured to receive power from the driving source, and a first output terminal and a second output terminal configured to transmit power to the second decelerator and the third decelerator, respectively.

According to some example embodiments, the second decelerator may include a second input terminal configured to receive power from the first output terminal, and two output terminals configured to receive power from the second input terminal. The first power transmitting member may be coupled to one of the two output terminals of the second decelerator.

According to some example embodiments, The motion assistance apparatus may further include a first restrainer configured to selectively restrain the first output terminal configured to transmit power to the second decelerator, and a second restrainer configured to selectively restrain, between the two output terminals of the second decelerator, an output terminal to which the first power transmitting member is not connected.

According to some example embodiments, the motion assistance apparatus may further include a first stopper configured to selectively block power to be transmitted from the first decelerator to the second decelerator, and a second stopper configured to selectively block power to be transmitted from the first decelerator and the third decelerator.

According to some example embodiments, the first power transmitting member and the second power transmitting member may be asymmetrically provided with respect to the driving module.

Some example embodiments relate to a motion assistance apparatus.

According to an example embodiment, the motion assistance apparatus includes a fixing member to be attached to a user, a driving module disposed on one side of the fixing member, the driving module including a driving source, a first decelerator configured to receive power from the driving source, and a second decelerator and a third decelerator configured to receive power from the first decelerator, a first supporting member and a second supporting member configured to support one portion and another portion of the user, respectively, a first power transmitting member configured to transmit power between an output terminal of the second decelerator and the first supporting member, and a second power transmitting member configured to transmit power between an output terminal of the third decelerator and the second supporting member.

Additional aspects of example embodiments will be set forth in part in the description which follows and, in part, will be apparent from the description, or may be learned by practice of the disclosure.

BRIEF DESCRIPTION OF THE DRAWINGS

These and/or other aspects of example embodiments will become apparent and more readily appreciated from the following description of some example embodiments, taken in conjunction with the accompanying drawings of which.

DETAILED DESCRIPTION

Figure 1:
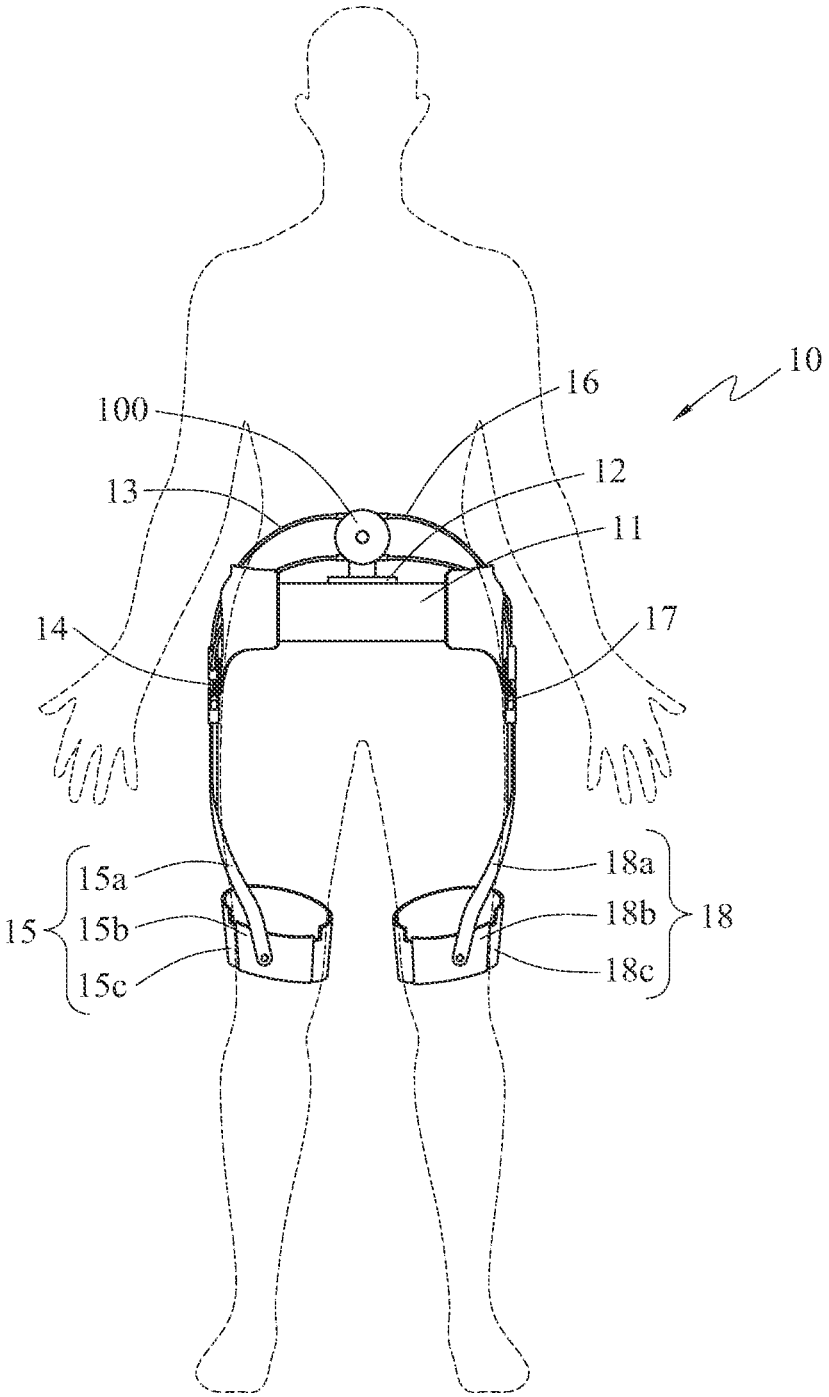
FIG. 1 is a front view illustrating a motion assistance apparatus according to an example embodiment.

Hereinafter, some example embodiments will be described in detail with reference to the accompanying drawings. In the accompanying drawings, like reference numerals may refer to like components throughout. Also, in the description of the example embodiments, detailed description of well-known or repetitive structures and/or functions will be omitted when it is deemed appropriate.

It should be understood, however, that there is no intent to limit this disclosure to the particular example embodiments disclosed herein. On the contrary, example embodiments are to cover all modifications, equivalents, and alternatives falling within the scope of the example embodiments.

In addition, terms such as first, second, A, B, (a), (b), and the like may be used herein to describe components. Each of these terminologies is not used to define an essence, order or sequence of a corresponding component but used merely to distinguish the corresponding component from other component(s). It should be noted that if it is described in the specification that one component is "connected", "coupled", or "joined" to another component, a third component may be "connected", "coupled", and "joined" between the first and second components, although the first component may be directly connected, coupled or joined to the second component.

The terminology used herein is for the purpose of describing particular example embodiments only and is not intended to be limiting. As used herein, the singular forms "a," "an," and "the," are intended to include the plural forms as well, unless the context clearly indicates otherwise. It will be further understood that the terms "comprises," "comprising," "includes," and/or "including," when used herein, specify the presence of stated features, integers, steps, operations, elements, and/or components, but do not preclude the presence or addition of one or more other features, integers, steps, operations, elements, components, and/or groups thereof.

Spatially relative terms, such as "beneath," "below," "lower," "above," "upper," and the like may be used herein for ease of description to describe the relationship of one component and/or feature to another component and/or feature, or other component(s) and/or feature(s), as illustrated in the drawings. It will be understood that the spatially relative terms are intended to encompass different orientations of the device in use or operation in addition to the orientation depicted in the figures.

It should also be noted that in some alternative implementations, the functions/acts noted may occur out of the order noted in the figures. For example, two figures shown in succession may in fact be executed substantially concurrently or may sometimes be executed in the reverse order, depending upon the functionality/acts involved.

Unless otherwise defined, all terms (including technical and scientific terms) used herein have the same meaning as commonly understood by one of ordinary skill in the art to which example embodiments belong. It will be further understood that terms, such as those defined in commonly used dictionaries, should be interpreted as having a meaning that is consistent with their meaning in the context of the relevant art and should not be interpreted in an idealized or overly formal sense unless expressly so defined herein.

Various example embodiments will now be described more fully with reference to the accompanying drawings in which some example embodiments are shown. In the drawings, the thicknesses of layers and regions are exaggerated for clarity.

A motion assistance apparatus according to example embodiments to be described hereinafter may drive a plurality of supporting modules simultaneously using a single driving source. The motion assistance apparatus may differentiate relative positions of the plurality of supporting modules using the single driving source. The motion assistance apparatus may allow power to be transmitted to the plurality of supporting modules simultaneously or alternately.

Figure 2:
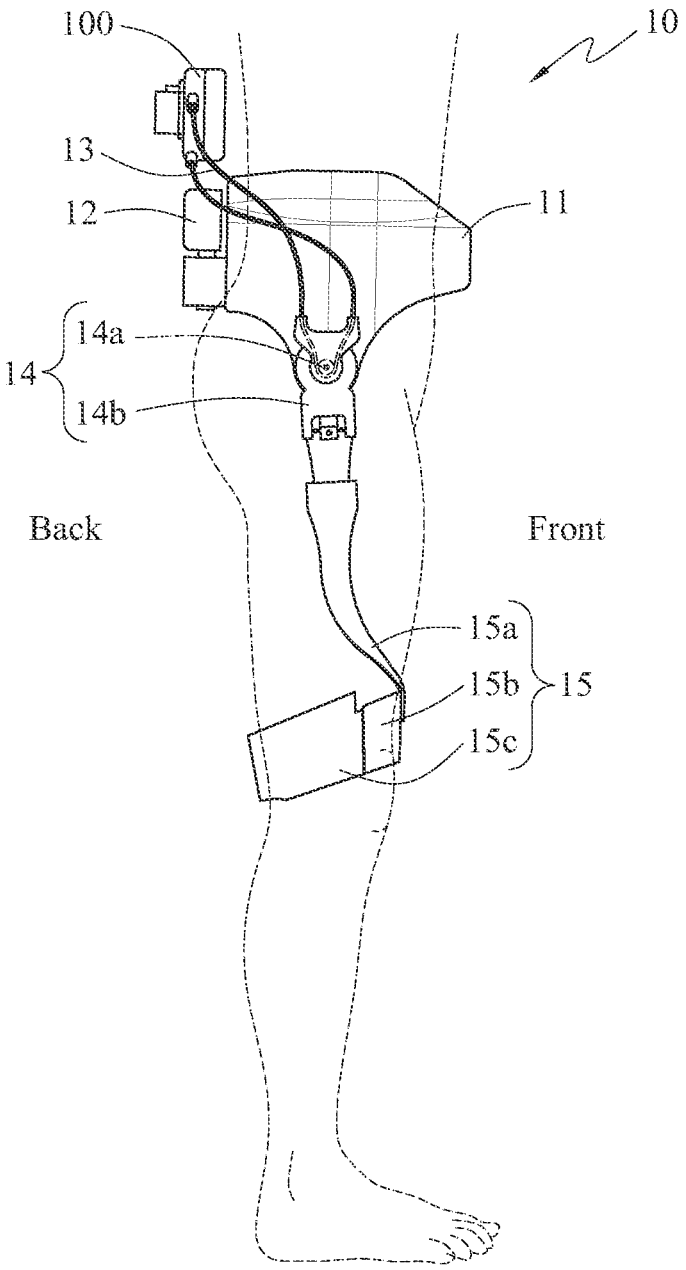
FIG. 2 is a left side view illustrating a motion assistance apparatus according to an example embodiment.
Figure 3:
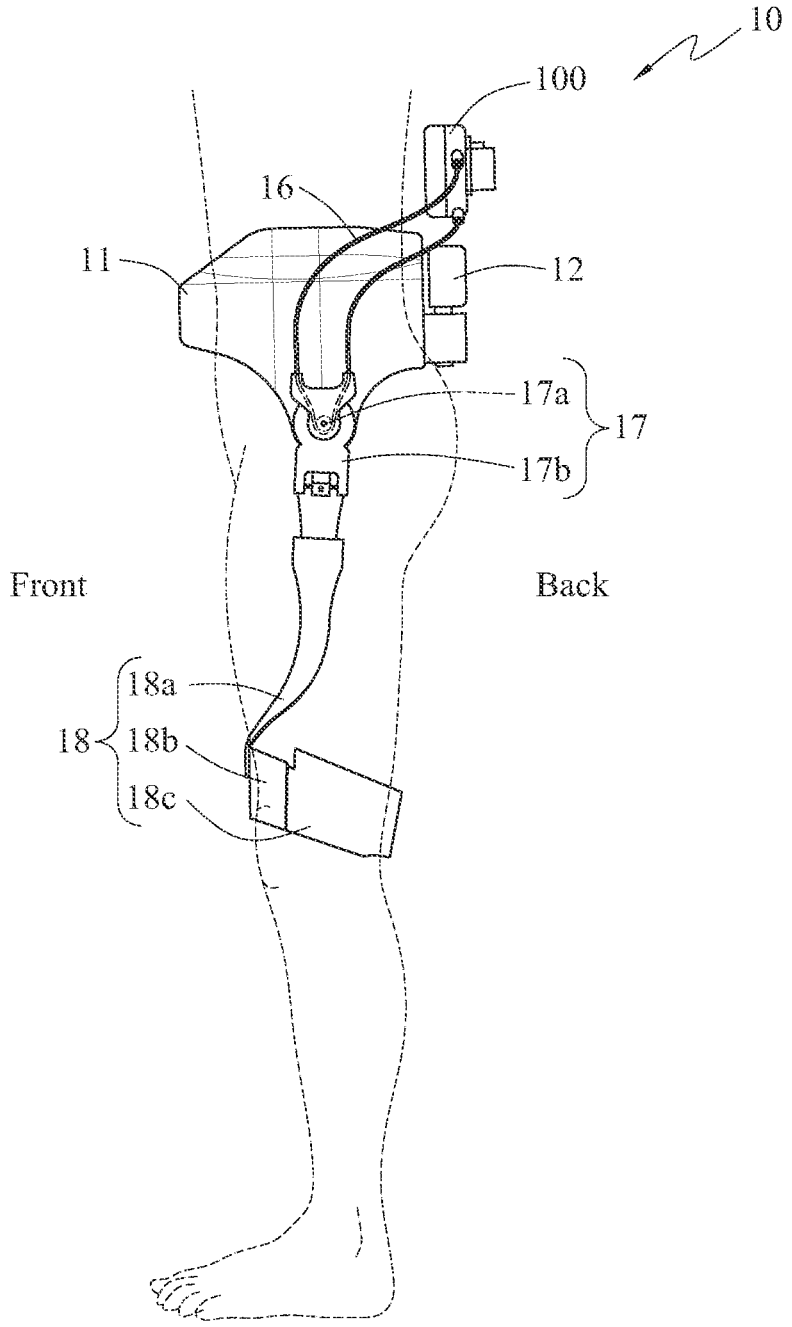
FIG. 3 is a right side view illustrating a motion assistance apparatus according to an example embodiment.

FIG. 1 is a front view illustrating a motion assistance apparatus according to an example embodiment, FIG. 2 is a left side view illustrating the motion assistance apparatus 10 according to an example embodiment, and FIG. 3 is a right side view illustrating the motion assistance apparatus according to an example embodiment.

Referring to FIGS. 1 through 3, a motion assistance apparatus 10 may be worn by a user to assist a motion of the user.

The user may be, for example, a human, an animal, or a robot. However, example embodiments are not limited thereto. Although FIG. 1 illustrates a case in which the motion assistance apparatus 10 assists a motion of a thigh of the user, the motion assistance apparatus 10 may assist a motion of another part of an upper body, for example, a hand, an upper arm, and a lower arm of the user, or a motion of another part of a lower body, for example, a foot, and a calf of the user. Thus, the motion assistance apparatus 10 may assist a motion of at least a part of the user.

Hereinafter, a case in which the motion assistance apparatus 10 assists a motion of a thigh of a human will be described.

The motion assistance apparatus 10 may include a fixing member 11, a driving module 100, a controller 12, a first power transmitting member 13, a second power transmitting member 16, a first supporting module 15, and a second supporting module 18.

The fixing member 11 may be attached or fixed to the user. The fixing member 11 may be in contact with at least a portion of an outer surface of the user. The fixing member 11 may be provided to cover the outer surface of the user. The fixing member 11 may be curved to conform to a contact portion of the user. The fixing member 11 may include a curved surface to be in contact with the user. For example, the fixing member 11 may be attached or fixed to one side of a waist of the user.

The driving module 100 may transmit power of a single driving source to the first supporting module 15 and the second supporting module 18. The driving module 100 may be provided on one side of the fixing member 11. For example, referring to FIG. 1, the driving module 100 may be provided on a rear side of the fixing member 11. The driving module 100 may be provided on an upper side of the fixing member 11. The driving module 100 may be disposed to be spaced apart from the first supporting module 15 and the second supporting module 18. The driving module 100 may be disposed on an opposite side of the first supporting module 15 and the second supporting module 18 with respect to the fixing member 11. According to the foregoing structure, a volume of a product to be disposed on a joint portion may be reduced. However, a position of the driving module 100 is not limited thereto. The driving module 100 will be described in detail later.

The controller 12 may control the driving module 100 to transmit power to the first supporting module 15 and the second supporting module 18. The controller 12 may be provided on one side of the fixing member 11. For example, referring to FIG. 1, the controller 12 may be provided on the rear side of the fixing member 11. The controller 12 may be provided on the upper side of the fixing member 11. However, a position of the controller 12 is not limited thereto.

The first power transmitting member 13 may be disposed between the driving module 100 and the first supporting module 15, and the second power transmitting member 16 may be disposed between the driving module 100 and the second supporting module 18. The first power transmitting member 13 may transmit power from the driving module 100 to the first supporting module 15, and the second power transmitting member 16 may transmit power from the driving module 100 to the second supporting module 18. The first power transmitting member 13 and the second power transmitting member 16 may respectively transmit power using, for example, pushing or pulling force, or transmit power using frictional force, tensile force, or elastic force. For example, the first power transmitting member 13 and the second power transmitting member 16 may respectively include, for example, a wire, a cable, a string, a rubber band, a spring, a belt, and a chain.

For example, power input terminals of the first power transmitting member 13 and the second power transmitting member 16 may be connected to the driving module 100, and power output terminals of the first power transmitting member 13 and the second power transmitting member 16 may be connected to a first joint assembly 14 connected to the first supporting module 15 and a second joint assembly 17 connected to the second supporting module 18, respectively.

The first joint assembly 14 may transmit power between the first power transmitting member 13 and the first supporting module 15, and the second joint assembly 17 may transmit power between the second power transmitting member 16 and the second supporting module 18. The first joint assembly 14 may be connected to the first power transmitting member 13 and the first supporting module 15, and the second joint assembly 17 may be connected to the second power transmitting member 16 and the second supporting module 18.

The first joint assembly 14 may include a first joint member **14*a*, and a first connecting member 14*b***.

The first joint member **14*a* may be configured to rotate using power received from the first power transmitting member 13. The first joint member 14*a* may be disposed on one side of a hip joint of the user. The first joint member 14*a*** may also be referred to as a "hip joint assistance member."

The first connecting member **14*b* may couple the first joint member 14*a* to the first supporting module 15. One side of the first connecting member 14*b* may be coupled to the first joint member 14*a*, and another side of the first connecting member 14*b* may be coupled to the first supporting module 15**.

The first connecting member 14*b* may be configured to rotate using torque of the first joint member 14*a*. The first connecting member 14*b* may be fastened with the first joint member 14*a* by a separate fastening member, or the first connecting member 14*b* and the first joint member 14*a* may be provided as an integral body.

The other side of the first connecting member 14*b* may be hinge-connected to the first supporting module 15. The other side of the first connecting member 14*b* and the first supporting module 15 may be connected to each other using a hinge connection structure. A hinge axis of the hinge connection structure may intersect an axis of rotation of the first joint member 14*a*. For example, the hinge axis of the hinge connection structure and the axis of rotation of the first joint member 14*a* may be orthogonal to each other. Thus, the first supporting module 15 may perform a two degree of freedom (DoF) motion with respect to the fixing member 11 by the hinge axis and the axis of rotation.

Similar to the first joint assembly 14, the second joint assembly 17 may include a second joint member 17*a*, and a second connecting member 17*b*. Detailed descriptions of the second joint member 17*a* and the second connecting member 17*b* will be omitted for conciseness.

The first power transmitting member 13 may transmit power from the driving module 100 to the first supporting module 15, and the second power transmitting member 16 may transmit power from the driving module 100 to the second supporting module 18.

The first power transmitting member 13 and the second power transmitting member 16 may be asymmetrically connected to each other with respect to the driving module 100.

For example, the first power transmitting member 13 may be provided in an overlapping manner, when seeing from a side of the motion assistance apparatus 10, between the driving module 100 and the first supporting module 15. The second power transmitting member 16 may be provided in a non-overlapping manner, when seeing from a side of the motion assistance apparatus 10, between the driving module 100 and the second supporting module 18. As shown in FIG. 2, the first power transmitting member 13 may be provided in a shape of "X," and as shown in FIG. 3, the second power transmitting member 16 may be connected in a shape of "II."

Referring to FIG. 2, a first portion of the first power transmitting member 13 may be connected to an upper side of the driving module 100 and a rear portion of the first supporting module 15. A second portion of the first power transmitting member 13 may be connected to a lower side of the driving module 100 and a front portion of the first supporting module 15. In this example, the first portion and the second portion of the first power transmitting member 13 may be provided to cross each other when seeing from a side of the motion assistance apparatus 10.

Referring to FIG. 3, a first portion of the second power transmitting member 16 may be connected to the upper side of the driving module 100 and a front portion of the second supporting module 18. A second portion of the second power transmitting member 16 may be connected to the lower side of the driving module 100 and a rear portion of the second supporting module 18. In this example, the first portion and the second portion of the second power transmitting member 16 may be provided to not cross each other when seeing from a side of the motion assistance apparatus 10. The first portion and the second portion of the second power transmitting member 16 may be provided to be parallel to each other.

The first power transmitting member 13 may be connected to enable two rotary members connected thereto to have opposite rotation directions. The second power transmitting member 16 may be connected to enable two rotary members connected thereto to have identical rotation directions.

The disposition of the first power transmitting member 13 and the second power transmitting member 16 is not limited thereto. For example, both of the first power transmitting member 13 and the second power transmitting member 16 may be provided such that the first and second portions of the respective power transmitting members are provided to cross each other, or are provided to not cross each other.

Tubes may be provided in external portions of the first power transmitting member 13 and the second power transmitting member 16, respectively. The tubes may guide the first power transmitting member 13 and the second power transmitting member 16. The tubes may be disposed between the driving module 100 and the first supporting module 15, and between the driving module 100 and the second supporting module 18, respectively. Through the tubes, the first power transmitting member 13 and the second power transmitting member 16 may operate without being obstructed by clothing while the user is wearing the clothing over the tubes. The tubes may be formed of a flexible material (e.g., rubber or silicone), or a rigid material (e.g., plastic or steel). The tubes may prevent a direct contact between the first power transmitting member 13 and the user and a direct contact between the second power transmitting member 16 and the user, thereby increasing a wearability.

The first supporting module 15 and the second supporting module 18 may support portions of the user, for example, thighs of the user. The first supporting module 15 and the second supporting module 18 may assist motions of the portions of the user. The first supporting module 15 and the second supporting module 18 may rotate using power received from the first power transmitting member 13 and the second power transmitting member 16, respectively. Torque of the first supporting module 15 and torque of the second supporting module 18 may be transmitted to the portions of the user to assist the motions of the portions of the user.

The first supporting module 15 may support a portion of the user, for example, a right thigh of the user, and the second supporting module 18 may support another portion of the user, for example, a left thigh of the user.

The first supporting module 15 may include a first supporting frame 15*a*, a first pressurizing member 15*b*, and a first supporting member 15*c*.

The first supporting frame 15*a* may be rotatably connected to the first joint assembly 14.

The first pressurizing member 15*b* may be connected to one side of the first supporting frame 15*a*. For example, the first pressurizing member 15*b* may be disposed on one side of the right thigh of the user to push or pull the right thigh of the user. The first pressurizing member 15*b* may be disposed on a front surface of the right thigh of the user.

The first supporting member 15*c* may be connected to one side of the first pressurizing member 15*b*. For example, the first supporting member 15*c* may be disposed to cover a circumference of at least a portion of the right thigh of the user to prevent a separation between the right thigh of the user and the first supporting frame 15*a*. The first supporting member 15*c* may be disposed on an opposite side of the first pressurizing member 15*b* with respect to the right thigh of the user.

Similar to the first supporting module 15, the second supporting module 18 may include a second supporting frame 18*a*, a second pressurizing member 18*b*, and a second supporting member 18*c*. Detailed descriptions of the second supporting frame 18*a*, the second pressurizing member 18*b*, and the second supporting member 18*c* will be omitted for conciseness.

The first joint assembly 14, the second joint assembly 17, the first supporting frame 15*a*, and the second supporting frame 18*a* may be omitted. Accordingly, the first power transmitting member 13 may connect the driving module 100 directly to the first supporting member 15*c*, and the second power transmitting member 16 may connect the driving module 100 directly to the second supporting member 18*c*. The first power transmitting member 13 may move the first supporting module 15 by directly pushing or pulling the first supporting member 15*c*, and the second power transmitting member 16 may move the second supporting module 18 by directly pushing or pulling the second supporting member 18*c*.

Figure 4:
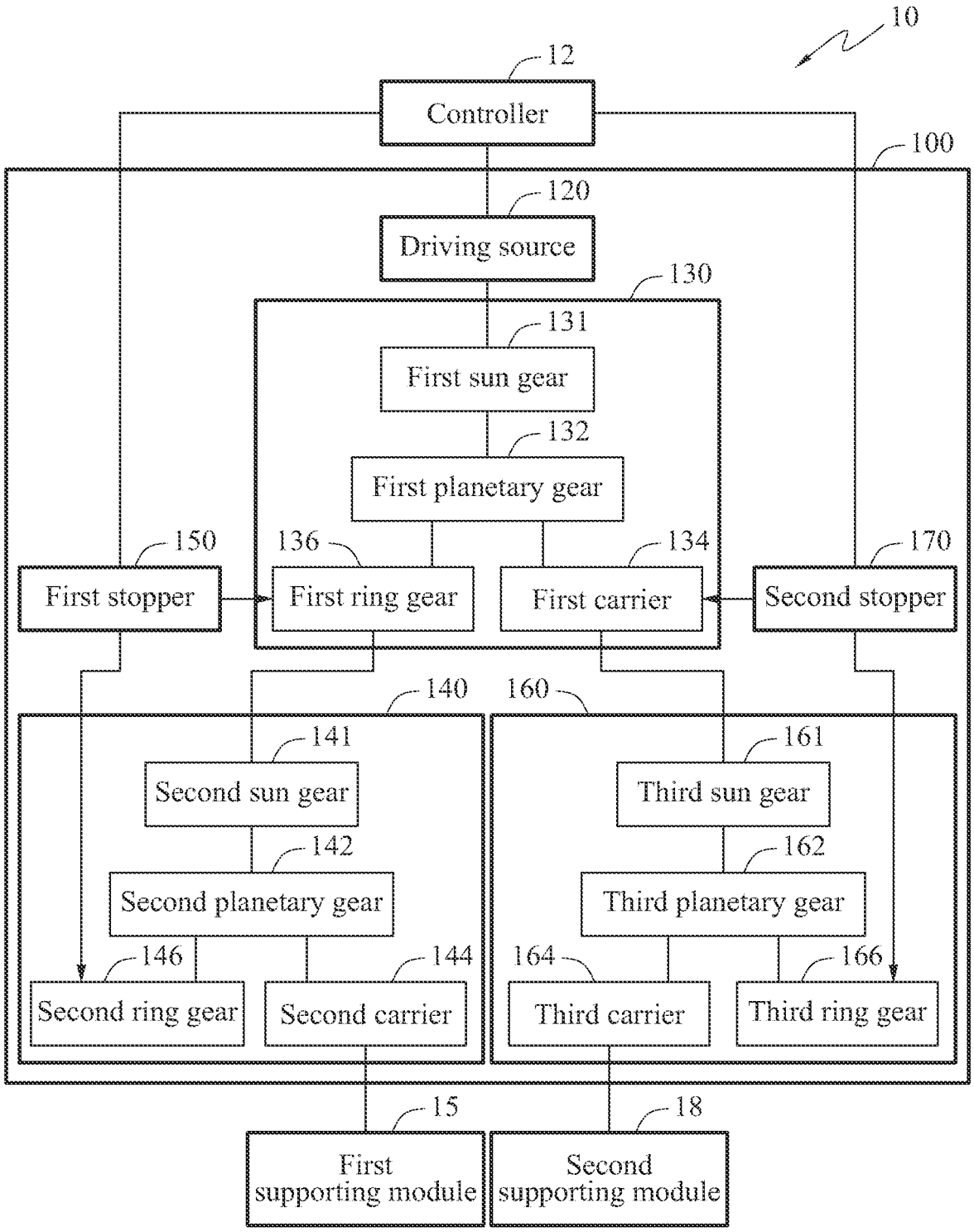
FIG. 4 is a block diagram illustrating a motion assistance apparatus according to an example embodiment.
Figure 5:
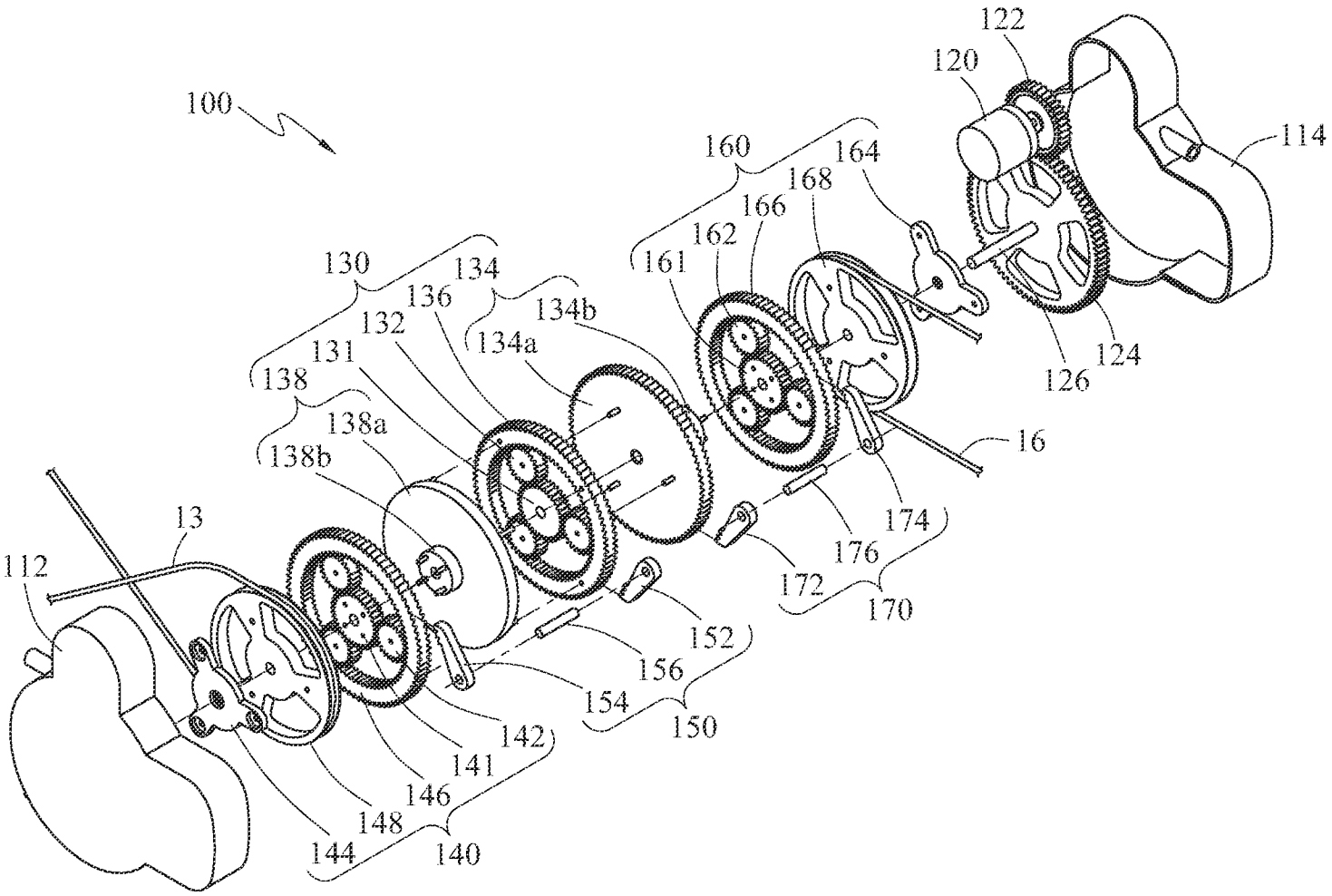
FIG. 5 is an exploded perspective view of a driving module according to an example embodiment.

FIG. 4 is a block diagram illustrating a motion assistance apparatus according to an example embodiment, and FIG. 5 is an exploded perspective view of a driving module according to an example embodiment.

Referring to FIGS. 4 and 5, the driving module 100 may include a first case 112, a second case 114, a driving source 120, a first decelerator 130, a second decelerator 140, a first stopper 150, a third decelerator 160, and a second stopper 170.

For example, the first decelerator 130, the second decelerator 140, and the third decelerator 160 may use a 3-port system, which includes a single input terminal and two output terminals. When power is transmitted using a toothed gear structure, each of the first decelerator 130, the second decelerator 140, and the third decelerator 160 may include a planetary gear type including a sun gear, which act as the input terminal, and a carrier and a ring gear, which act as the output terminals. When power is transmitted by rolling friction, each of the first decelerator 130, the second decelerator 140, and the third decelerator 160 may include a primary pulley acting as the input terminal, and a secondary pulley and a tertiary pulley acting as the output terminals, similar to the planetary gear type. When power is transmitted by a harmonic drive structure, each of the first decelerator 130, the second decelerator 140, and the third decelerator 160 may include a wave generator acting as the input terminal, and a flexspline and a circular spline acting as the output terminals. A 3-port system may be sufficient for each of the first decelerator 130, the second decelerator 140, and the third decelerator 160. However, example embodiments are not limited thereto. Hereinafter, a case in which each of the first decelerator 130, the second decelerator 140, and the third decelerator 160 transmits power using toothed gear structures will be described as an example. However, example embodiments are not limited thereto.

The first case 112 and the second case 114 may form an exterior or an appearance of the driving module 100. The first case 112 and the second case 114 may prevent a direct contact between inner components of the driving module 100 and a user, thereby increasing a wearability.

The driving source 120 may include, for example, a motor configured to receive voltage or current and generate power, or a pump operated by a fluid pressure. However, types of the power providing device are not limited thereto.

The driving module 100 may include a driving gear 122 configured to receive power from the driving source 120, a decelerating gear 124 connected to the driving gear 122 to decelerate a rotation velocity, and a power providing shaft 126 connected to the decelerating gear 124 to transmit power to the first decelerator 130.

The first decelerator 130 may receive power from the driving source 120, and transmit power to the second decelerator 140 and/or the third decelerator 160. For example, the first decelerator 130 may transmit power to at least one of the second decelerator 140 and the third decelerator 160. For example, the first decelerator 130 may transmit power to the second decelerator 140 and the third decelerator 160 simultaneously, or transmit power to only one of the second decelerator 140 and the third decelerator 160.

The first decelerator 130 may include a first sun gear 131, a first planetary gear 132, a first carrier 134, and a first ring gear 136. The first sun gear 131 may act as an input terminal of the first decelerator 130, and the first carrier 134 and the first ring gear 136 may act as output terminals of the first decelerator 130.

The first sun gear 131 may be coupled to the power providing shaft 126 to transmit power to the first planetary gear 132.

The first planetary gear 132 may be coupled to the first sun gear 131 and the first ring gear 136. The first planetary gear 132 may be engaged with the first sun gear 131 and the first ring gear 136. The first planetary gear 132 may be engaged to an outer circumferential surface of the first sun gear 131 and an inner circumferential surface of the first ring gear 136. The first planetary gear 132 may interact with, for example, the first sun gear 131 and the first ring gear 136. At least one first planetary gear 132 may be disposed. When a plurality of first planetary gears 132 is provided, the first planetary gears 132 may be disposed at substantially identical angular intervals with respect to an axis of rotation of the first sun gear 131.

The first carrier 134 may be coupled to an axis of rotation of the first planetary gear 132 and the axis of rotation of the first sun gear 131. Through the foregoing structure, the first carrier 134 may rotate on the axis of rotation of the first sun gear 131 when the first planetary gear 132 revolves around the first sun gear 131. Conversely, the first carrier 134 may not rotate when the first planetary gear 132 does not revolve around the first sun gear 131.

The first carrier 134 may include a first body portion 134*a* to be coupled to the first planetary gear 132, and a first output terminal 134*b* to be coupled to an input terminal of the third decelerator 160, for example, a third sun gear 161. An outer circumferential surface of the first body portion 134*a* may be contacted by the second stopper 170.

The first ring gear 136 may be coupled to the first planetary gear 132. The first ring gear 136 may be engaged with the first planetary gear 132. The first ring gear 136 may rotate using torque of the first planetary gear 132. The first ring gear 136 may include an inner surface to be coupled to the first planetary gear 132, and an outer surface of the first ring gear 136 may be contacted by the first stopper 150. For example, the inner surface and/or the outer surface of the first ring gear 136 may include teeth.

The first ring gear 136 may transmit power to the second decelerator 140. A torque transmitting member 138 may be interposed between the first ring gear 136 and the second decelerator 140. The torque transmitting member 138 may include a second body portion 138*a* to be connected to the first ring gear 136, and a second output terminal 138*b* to be connected to an input terminal of the second decelerator 140, for example, a second sun gear 141. Although FIG. 5 illustrates an outer surface of the first ring gear 136 is configured to be stopped by the first stopper 150 and an outer circumferential surface of the first body portion 134*a* is configured to be stopped by the second stopper 170, the outer circumferential surface of the first body portion 134*a* may be stopped by the first stopper 150. The torque transmitting member 138 and the first ring gear 136 may be provided in an integral body.

The second decelerator 140 may include the second sun gear 141, a second planetary gear 142, a second carrier 144, a second ring gear 146, and a first pulley 148.

The second sun gear 141 may be coupled to the second output terminal 138*b* of the first decelerator 130 to receive power.

The second planetary gear 142, the second carrier 144, and the second ring gear 146 may have the same structures as the first planetary gear 132, the first carrier 134, and the first ring gear 136, respectively. Thus, duplicated descriptions will be omitted for conciseness.

The first pulley 148 may transmit power to the first power transmitting member 13. The first power transmitting member 13 may be wound over an outer surface of the first pulley 148.

The first pulley 148 may rotate using torque of the second carrier 144. A rotation velocity and a rotation direction of the first pulley 148 may be identical to a rotation velocity and a rotation direction of the second carrier 144. The first pulley 148 and the second carrier 144 may perform a single rigid body motion. For example, the first pulley 148 may be fastened with the second carrier 144 by a separate fastening member, or the first pulley 148 and the second carrier 144 may form an integral body.

The first stopper 150 may include a first restrainer 152 configured to selectively allow the first ring gear 136 to rotate, a second restrainer 154 configured to selectively allow the second ring gear 146 to rotate, and a first stopper shaft 156 configured to connect the first restrainer 152 to the second restrainer 154.

The first restrainer 152 may selectively block power to be transmitted from the first decelerator 130 to the second decelerator 140. The first restrainer 152 may selectively restrain the first ring gear 136. For example, the first restrainer 152 may include teeth of a shape corresponding to teeth formed on the outer circumferential surface of the first ring gear 136. According to another example embodiment, the first restrainer 152 may restrain the first ring gear 136 by selectively restraining the torque transmitting member 138.

The second restrainer 154 may selectively restrain the second ring gear 146. For example, the second restrainer 154 may include teeth of a shape corresponding to teeth formed on the outer circumferential surface of the second ring gear 146.

The first restrainer 152 and the second restrainer 154 may be provided in an integral body. In this example, based on a rotation angle of the first stopper 150, the first stopper 150 may selectively restrain the first ring gear 136 or the second ring gear 146.

The first stopper shaft 156 may function as a central axis of rotation of the first restrainer 152 and the second restrainer 154. The first stopper shaft 156 may be fixed to at least one of the first case 112 and the second case 114.

The third decelerator 160 may be disposed to be symmetric to the second decelerator 140 with respect to the first decelerator 130. Similar to the second decelerator 140, the third decelerator 160 may include the third sun gear 161, a third planetary gear 162, a third carrier 164, a third ring gear 166, and a second pulley 168.

The third sun gear 161 may be coupled to the first output terminal 134*b* of the first decelerator 130 to receive power.

The third planetary gear 162, the third carrier 164, and the third ring gear 166 may have the same structures as the first planetary gear 132, the first carrier 134, and the first ring gear 136, respectively. Thus, duplicated descriptions will be omitted for conciseness.

The second pulley 168 may transmit power to the second power transmitting member 16. The second power transmitting member 16 may be wound over an outer surface of the second pulley 168. The second pulley 168 may have the same structure as the first pulley 148. Thus, duplicated descriptions will be omitted for conciseness.

The second stopper 170 may include a third restrainer 172 configured to selectively allow the first carrier 134 to rotate, a fourth restrainer 174 configured to selectively allow the third ring gear 166 to rotate, and a second stopper shaft 176 configured to connect the third restrainer 172 to the fourth restrainer 174.

The third restrainer 172 may selectively block power to be transmitted from the first decelerator 130 to the third decelerator 160. The third restrainer 172 may selectively restrain the first carrier 134. For example, the third restrainer 172 may include teeth of a shape corresponding to teeth formed on the outer circumferential surface of the first carrier 134.

The fourth restrainer 174 may selectively restrain the third ring gear 166. For example, the fourth restrainer 174 may include teeth of a shape corresponding to teeth formed on the outer circumferential surface of the third ring gear 166.

The third restrainer 172 and the fourth restrainer 174 may be provided in an integral body. In this example, based on a rotation angle of the second stopper 170, the second stopper 170 may selectively restrain the first carrier 134 or the third ring gear 166.

The second stopper shaft 176 may function as a central axis of rotation of the third restrainer 172 and the fourth restrainer 174. The second stopper shaft 176 may be fixed to at least one of the first case 112 and the second case 114. The second stopper shaft 176 and the first stopper shaft 156 may be provided in an integral body.

The motion assistance apparatus 10 may transmit power to the first supporting module 15 and the second supporting module 18 simultaneously, as follows.

The controller 12 may power on the driving source 120 to transmit power to the first decelerator 130. Further, the controller 12 may operate the first stopper 150 to restrain the second ring gear 146, and operate the second stopper 170 to restrain the third ring gear 166.

The power transmitted from the driving source 120 to the first sun gear 131 may be transmitted to the first planetary gear 132, and the power transmitted to the first planetary gear 132 may be transmitted to the first ring gear 136 and the first carrier 134.

In a state in which the second ring gear 146 and the third ring gear 166 are restrained, a gear ratio from the first sun gear 131 to the output terminal of the second decelerator 140 may be referred to as a "first gear ratio N1", and a gear ratio from the first sun gear 131 to the output terminal of the third decelerator 160 may be referred to as a "second gear ratio N2".

The first gear ratio N1 may be defined as a gear ratio from the first sun gear 131 to the second carrier 144. The second gear ratio N2 may be defined as a gear ratio from the first sun gear 131 to the third carrier 164.

The first gear ratio N1 may differ from the second gear ratio N2. Based on a difference between the first gear ratio N1 and the second gear ratio N2, the second carrier 144 and the third carrier 164 may rotate at different angular velocities. Thus, the first supporting module 15 receiving power from the second sun gear 141 through the second planetary gear 142 and the second carrier 144 and the second supporting module 18 receiving power from the third sun gear 161 through the third planetary gear 162 and the third carrier 164 may rotate at different angular velocities. Because neither the first ring gear 136 nor the first carrier 134 is restrained, a torque provided to the first supporting module 15 and a torque provided to the second supporting module 18 are symmetric to each other. Using the forgoing method, assistance force suitable for a gait motion of the user, in detail, a gait motion on the level ground, may be provided.

The motion assistance apparatus 10 may alternately transmit power to the first supporting module 15 and the second supporting module 18, as follows.

A case in which the first supporting module 15 is driven will be as follows.

The controller 12 may power on the driving source 120 to transmit power to the first decelerator 130. Further, the controller 12 may operate the first stopper 150 to restrain the second ring gear 146, and operate the second stopper 170 to restrain the first carrier 134.

The power transmitted from the driving source 120 to the first sun gear 131 may be transmitted to the first planetary gear 132, and the power transmitted to the first planetary gear 132 may be used to rotate the first ring gear 136. In this example, because the first carrier 134 is being restrained by the second stopper 170, the power received from the first sun gear 131 may be transmitted entirely to the first ring gear 136.

Thus, the first supporting module 15 receiving power from the first ring gear 136 through the second sun gear 141, the second planetary gear 142, and the second carrier 144 may rotate in a direction.

Because the first carrier 134 is being restrained, power may not be transmitted to the second supporting module 18 coupled to the first carrier 134 through the third decelerator 160.

A case in which the second supporting module 18 is driven will be as follows.

The controller 12 may operate the first stopper 150 to restrain the first ring gear 136, and operate the second stopper 170 to restrain the third ring gear 166.

The power transmitted from the driving source 120 to the first sun gear 131 may be transmitted to the first planetary gear 132, and the power transmitted to the first planetary gear 132 may be used to rotate the first carrier 134. In this example, because the first ring gear 136 is being restrained by the first stopper 150, the power received from the first sun gear 131 may be transmitted entirely to the first carrier 134.

Thus, the second supporting module 18 receiving power from the first carrier 134 through the third sun gear 161, the third planetary gear 162, and the third carrier 164 may rotate in a direction.

Because the first ring gear 136 is being restrained, power may not be transmitted to the first supporting module 15 coupled to the first ring gear 136 through the second decelerator 140.

By selectively adjusting operations of the first stopper 150 and the second stopper 170, the motion assistance apparatus 10 may operate the first supporting module 15 and the second supporting module in an alternative manner. Using the foregoing method, assistance force suitable for a gait motion of the user, in detail, a gait motion on a slope (in other words, inclined and/or declined walking), may be provided.

As illustrated in FIGS. 1 through 3, one of the first power transmitting member 13 and the second power transmitting member 16 may be provided in an overlapping manner, and the other of the first power transmitting member 13 and the second power transmitting member 16 may be provided in a non-overlapping manner. Based on different connection structures of the first power transmitting member 13 and the second power transmitting member 16, the first supporting module 15 and the second supporting module 18 may alternately operate in the same direction by controlling the first stopper 150 and the second stopper 170, without changing a rotation direction of the first sun gear 131.

Even in a case at which the first power transmitting member 13 and the second power transmitting member 16 have a same connection structure, the alternative operation of the first supporting module 15 and the second supporting module 18 may be performed by alternating the rotation direction of the first sun gear 131.

The motion assistance apparatus 10 may block power to be transmitted to the first supporting module 15 and the second supporting module 18, as follows.

The controller 12 may operate the first stopper 150 to restrain the first ring gear 136, and operate the second stopper 170 to restrain the first carrier 134. In this example, power to be transmitted to the second decelerator 140 and the third decelerator 160 may be blocked, and thus may not be transmitted to the first supporting module 15 and the second supporting module 18.

Because neither the second ring gear 146 nor the second carrier 144 is restrained, the first supporting module 15 may move freely (e.g., move without being influenced by the power supplied by the driving source 120). Similarly, because neither the third ring gear 166 nor the third carrier 164 is restrained, the second supporting module 18 may move freely. Thus, using the foregoing method, the user may perform motions freely.

The motion states described above may be arranged as shown in Table 1.

TABLE 1

| Motion State | | First Stopper | | Second Stopper | |
|---|---|---|---|---|---|
| | | First Ring Gear | Second Ring Gear | First Carrier | Third Ring Gear |
| Simultaneous Power Transmission (Level Walking) | | Release | Restraint | Release | Restraint |
| Alternate Power Transmission (Slope Walking) | First Supporting Module Movement | Release | Restraint | Restraint | Release |
| | Second Supporting Module Movement | Restraint | Release | Release | Restraint |
| Power Blocking (Free Motion) | | Restraint | Release | Restraint | Release |

Hereinafter, the same name may be used to describe an element included in the example embodiments described above and an element having a common function. Unless otherwise mentioned, the descriptions on the foregoing example embodiments may be applicable to the following example embodiments and thus, duplicated descriptions will be omitted for conciseness.

Figure 6:
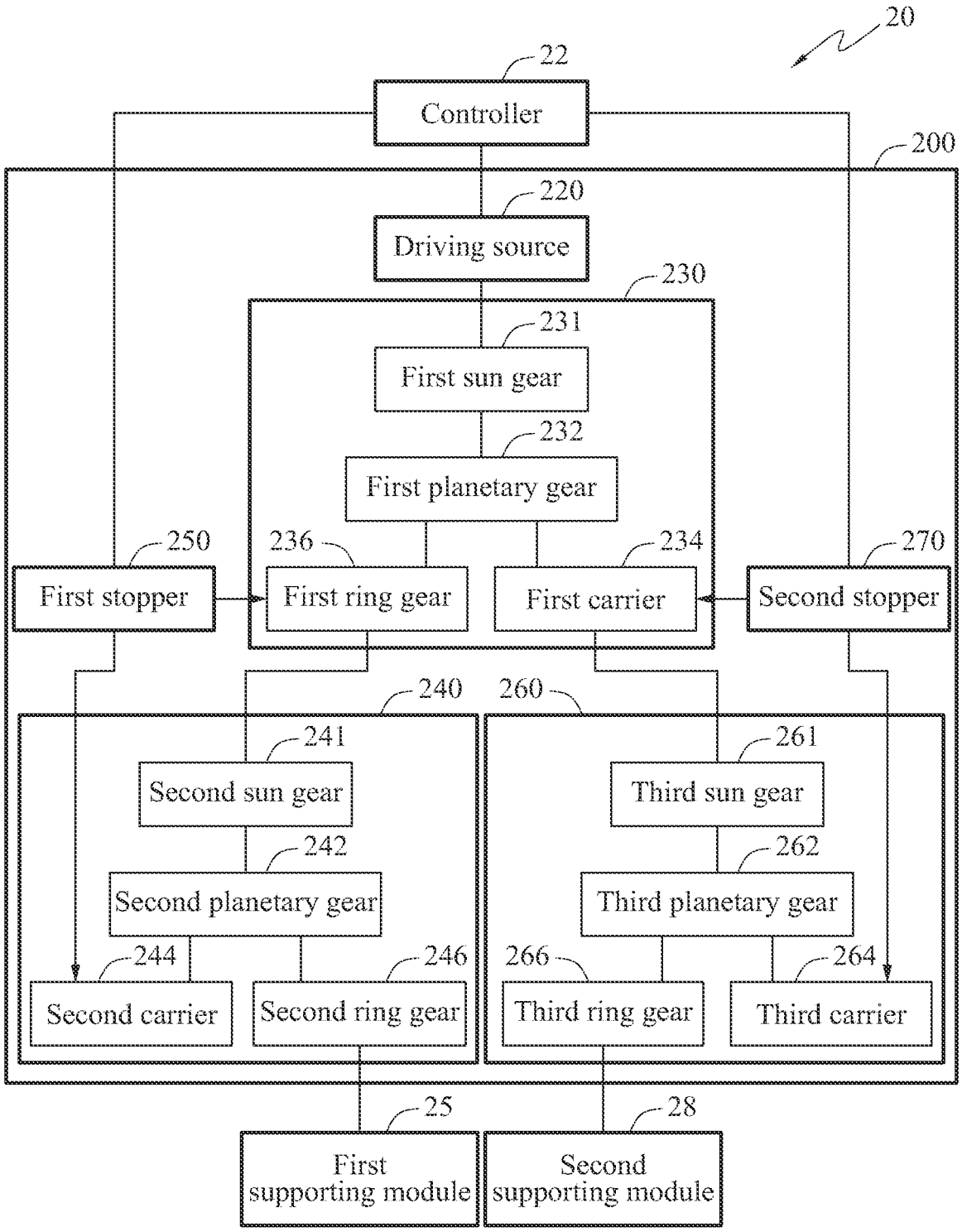
FIG. 6 is a block diagram illustrating a motion assistance apparatus according to an example embodiment.

FIG. 6 is a block diagram illustrating a motion assistance apparatus according to an example embodiment.

Referring to FIG. 6, an motion assistance apparatus 20 may include a controller 22, a driving module 200, a first supporting module 25, and a second supporting module 28.

The driving module 200 may include a driving source 220, a first decelerator 230, a second decelerator 240, a first stopper 250, a third decelerator 260, and a second stopper 270.

The first decelerator 230 may include a first sun gear 231, a first planetary gear 232, a first carrier 234, and a first ring gear 236.

The second decelerator 240 may include a second sun gear 241, a second planetary gear 242, a second carrier 244, and a second ring gear 246.

The first stopper 250 may include a first restrainer configured to selectively restrain the first ring gear 236, and a second restrainer configured to selectively restrain the second carrier 244. The first restrainer and the second restrainer may be provided in an integral body. In this example, the first stopper 250 may selectively restrain one of the first ring gear 236 and the second carrier 244.

The third decelerator 260 may include a third sun gear 261, a third planetary gear 262, a third carrier 264, and a third ring gear 266.

The second stopper 270 may include a third restrainer configured to selectively restrain the first carrier 234, and a fourth restrainer configured to selectively restrain the third carrier 264. The third restrainer and the fourth restrainer may be provided in an integral body. In this example, the second stopper 270 may selectively restrain one of the first carrier 234 and the third carrier 264.

The first supporting module 25 may be coupled to the second ring gear 246, and the second supporting module 28 may be coupled to the third ring gear 266.

The motion assistance apparatus 20 may operate as shown in Table 2.

TABLE 2

| Motion State | | First Stopper | | Second Stopper | |
|---|---|---|---|---|---|
| | | First Ring Gear | Second Carrier | First Carrier | Third Carrier |
| Simultaneous Power Transmission (Level Walking) | | Release | Restraint | Release | Restraint |
| Alternate Power Trans-mission (Slope Walking) | First Supporting Module Movement | Release | Restraint | Restraint | Release |
| | Second Supporting Module Movement | Restraint | Release | Release | Restraint |
| Power Blocking (Free Motion) | | Restraint | Release | Restraint | Release |

Figure 7:
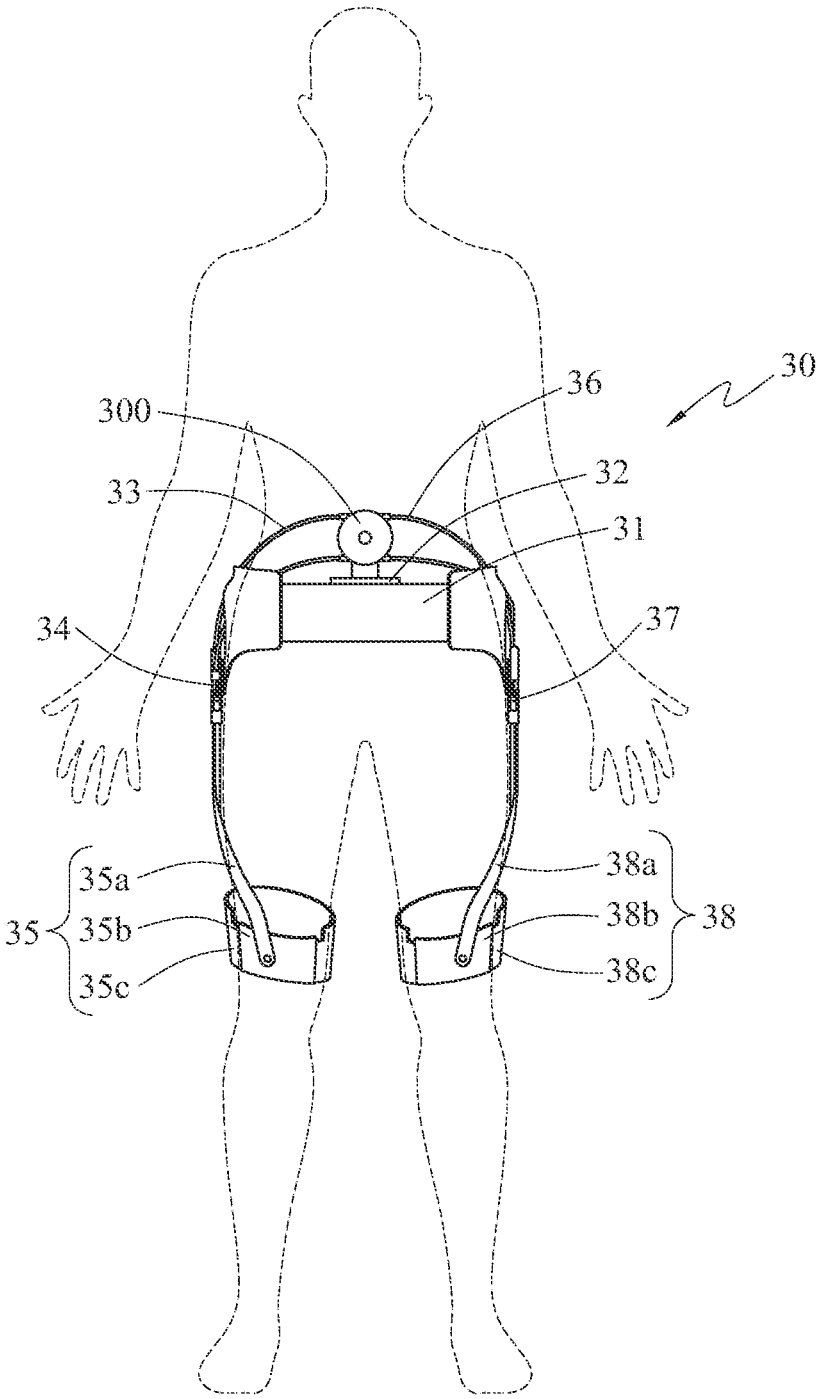
FIG. 7 is a front view illustrating a motion assistance apparatus according to an example embodiment.
Figure 8:
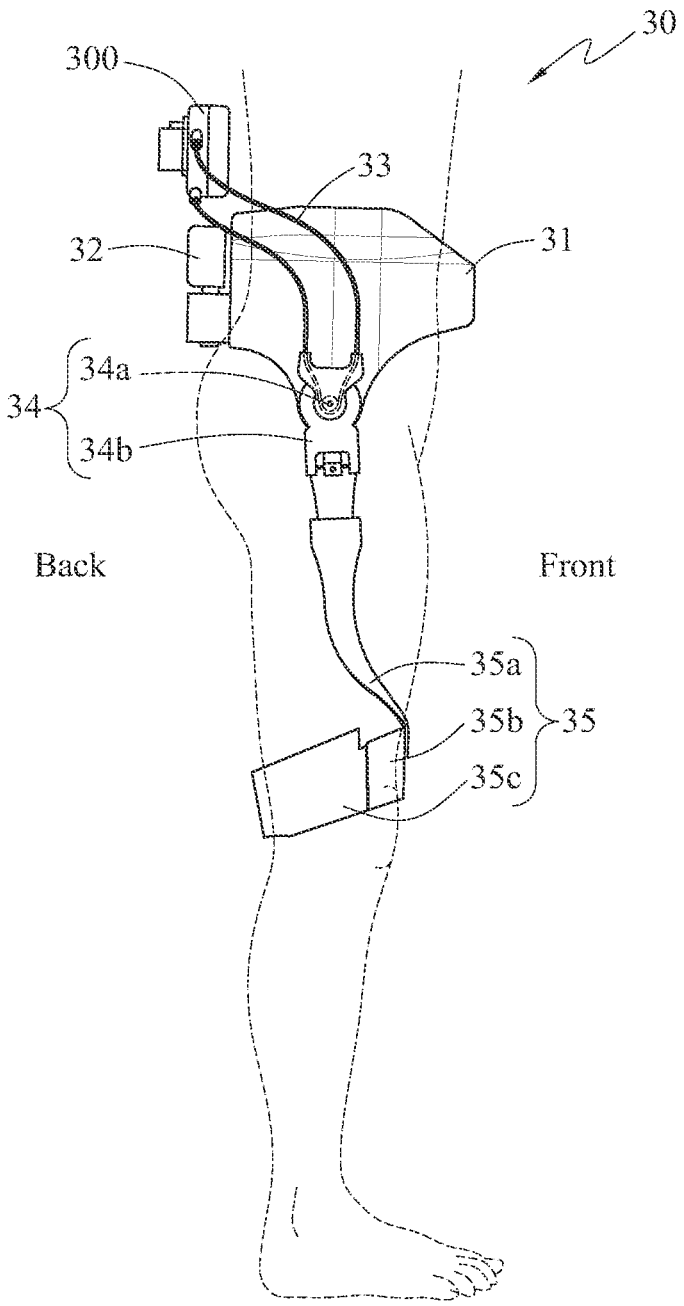
FIG. 8 is a left side view illustrating a motion assistance apparatus according to an example embodiment.
Figure 9:
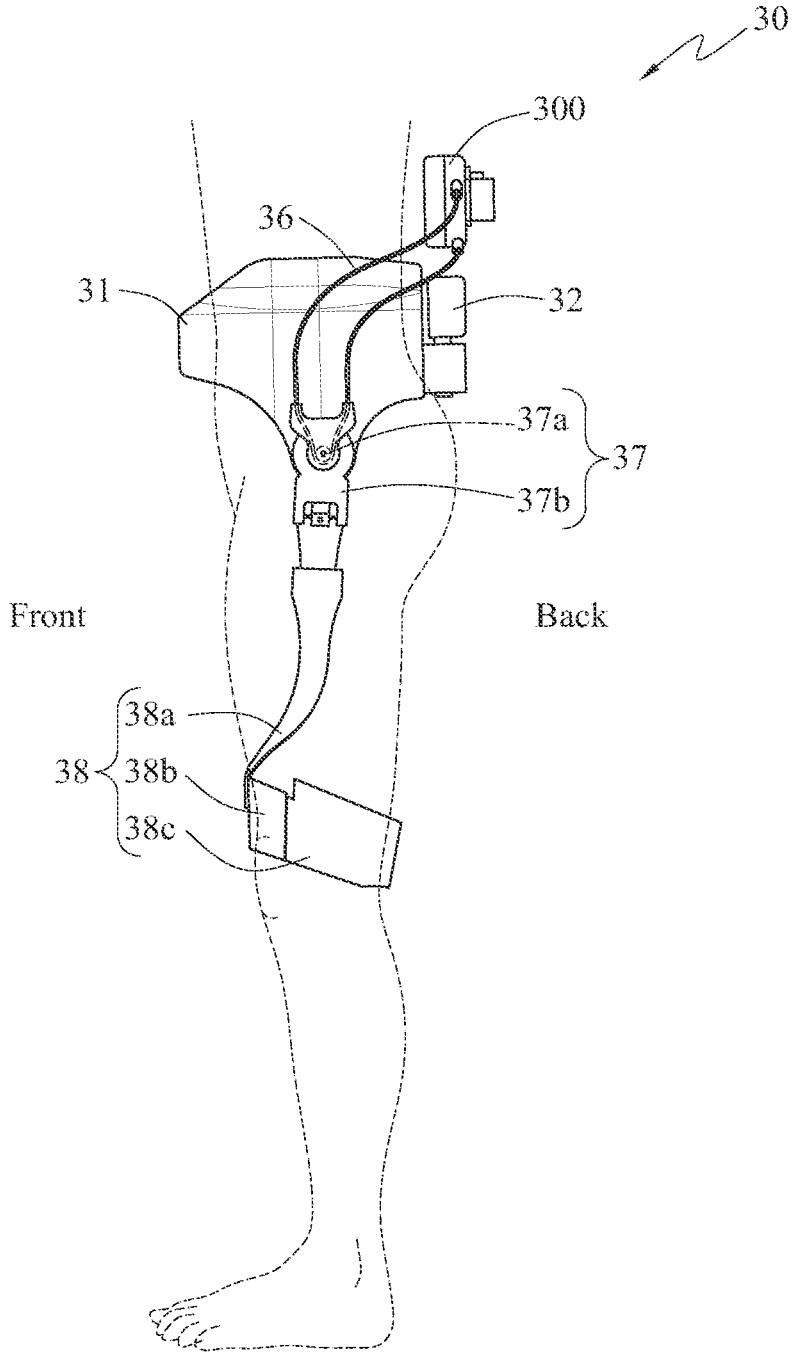
FIG. 9 is a right side view illustrating a motion assistance apparatus according to an example embodiment.

FIG. 7 is a front view illustrating a motion assistance apparatus according to an example embodiment, FIG. 8 is a left side view illustrating a motion assistance apparatus according to an example embodiment, and FIG. 9 is a right side view illustrating a motion assistance apparatus 30 according to an example embodiments.

Referring to FIGS. 7 through 9, a motion assistance apparatus 30 may include a fixing member 31, a driving module 300, a controller 32, a first power transmitting member 33, a first joint assembly 34, a second power transmitting member 36, a first supporting module 35, a second joint assembly 37, and a second supporting module 38.

The first power transmitting member 33 and the second power transmitting member 36 may be symmetrically connected to each other with respect to the driving module 300. For example, the first power transmitting member 33 may be provided in a non-overlapping manner between the driving module 300 and the first supporting module 35, and the second power transmitting member 36 may be provided in a non-overlapping manner between the driving module 300 and the second supporting module 38.

Figure 10:
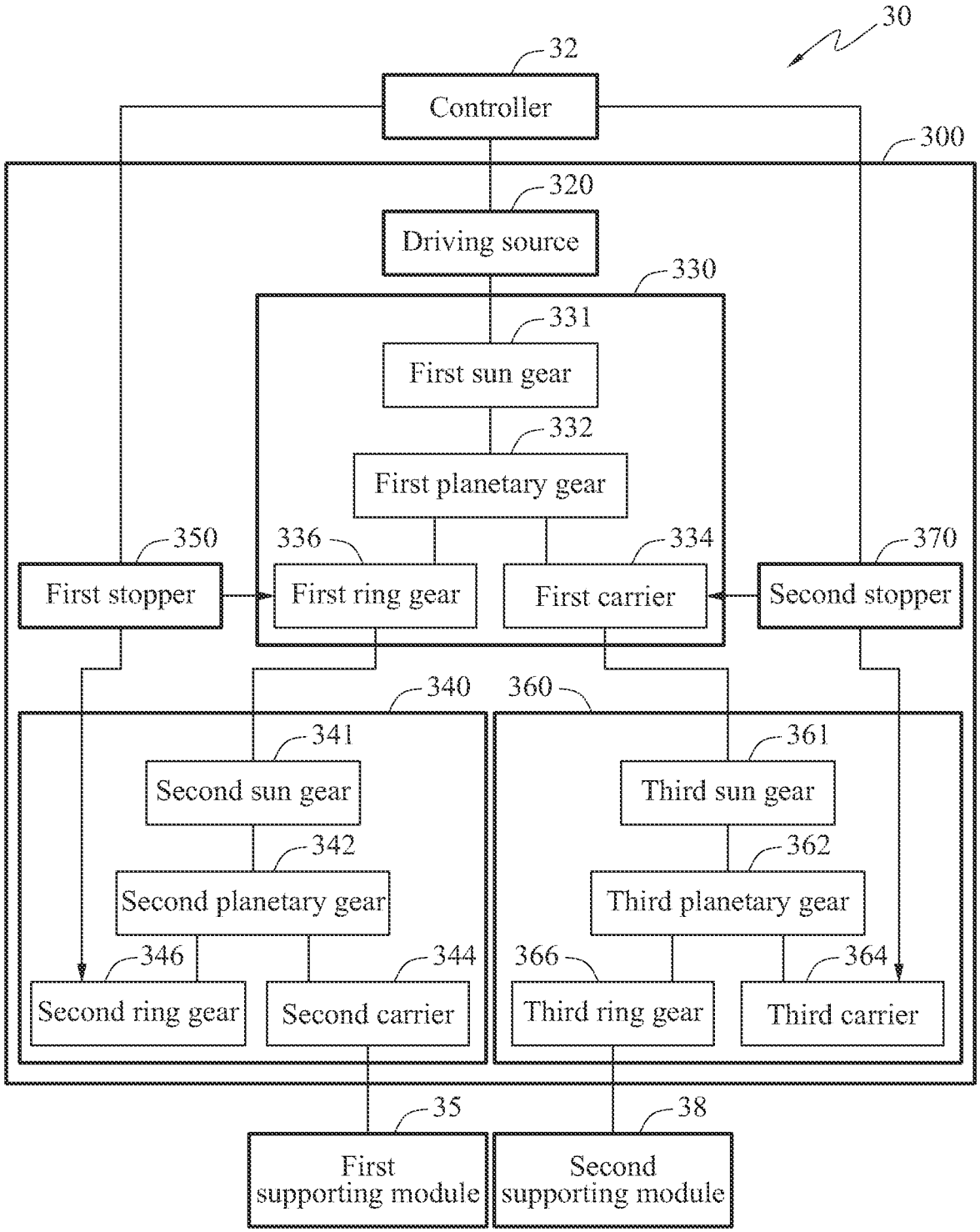
FIG. 10 is a block diagram illustrating a motion assistance apparatus according to an example embodiment.

Based on this connection structure of the first power transmitting member 33 and the second power transmitting member 36 and by controlling a first stopper 350 and a second stopper 370 of FIG. 10, the first supporting module 35 and the second supporting module 38 may alternately operate in the same direction without changing a rotation direction of a first sun gear 331 of FIG. 10.

Even in a case at which the first power transmitting member 33 and the second power transmitting member 36 have a same connection structure, for example, when the first power transmitting member 33 is provided in an overlapping manner between the driving module 300 and the first supporting module 35, and the second power transmitting member 36 is provided in an overlapping manner between the driving module 300 and the second supporting module 38, the alternative operation of the first supporting module 15 and the second supporting module 18 may be performed by alternating the rotation direction of the first sun gear 331 of FIG. 10.

FIG. 10 is a block diagram illustrating a motion assistance apparatus according to an example embodiment.

Referring to FIG. 10, a motion assistance apparatus 30 may include the controller 32, the driving module 300, the first supporting module 35, and the second supporting module 38.

The driving module 300 may include a driving source 320, a first decelerator 330, a second decelerator 340, the first stopper 350, a third decelerator 360, and the second stopper 370.

The first decelerator 330 may include the first sun gear 331, a first planetary gear 332, a first carrier 334, and a first ring gear 336.

The second decelerator 340 may include a second sun gear 341, a second planetary gear 342, a second carrier 344, and a second ring gear 346.

The first stopper 350 may include a first restrainer configured to selectively restrain the first ring gear 336, and a second restrainer configured to selectively restrain the second ring gear 346. The first restrainer and the second restrainer may be provided in an integral body. In this example, the first stopper 350 may selectively restrain one of the first ring gear 336 and the second ring gear 346.

The third decelerator 360 may include a third sun gear 361, a third planetary gear 362, a third carrier 364, and a third ring gear 366.

The second stopper 370 may include a third restrainer configured to selectively restrain the first carrier 334, and a fourth restrainer configured to selectively restrain the third carrier 364. The third restrainer and the fourth restrainer may be provided in an integral body. In this example, the second stopper 370 may selectively restrain one of the first carrier 334 and the third carrier 364.

The first supporting module 35 may be coupled to the second carrier 344, and the second supporting module 38 may be coupled to the third ring gear 366.

The motion assistance apparatus 30 may operate as shown in Table 3.

TABLE 3

| Motion State | | First Stopper | | Second Stopper | |
|---|---|---|---|---|---|
| | | First Ring Gear | Second Ring Gear | First Carrier | Third Carrier |
| Simultaneous Power Transmission (Level Walking) | | Release | Restraint | Release | Restraint |
| Alternate Power Trans-mission (Slope Walking) | First Supporting Module Movement | Release | Restraint | Restraint | Release |
| | Second Supporting Module Movement | Restraint | Release | Release | Restraint |
| Power Blocking (Free Motion) | | Restraint | Release | Restraint | Release |

Figure 11:
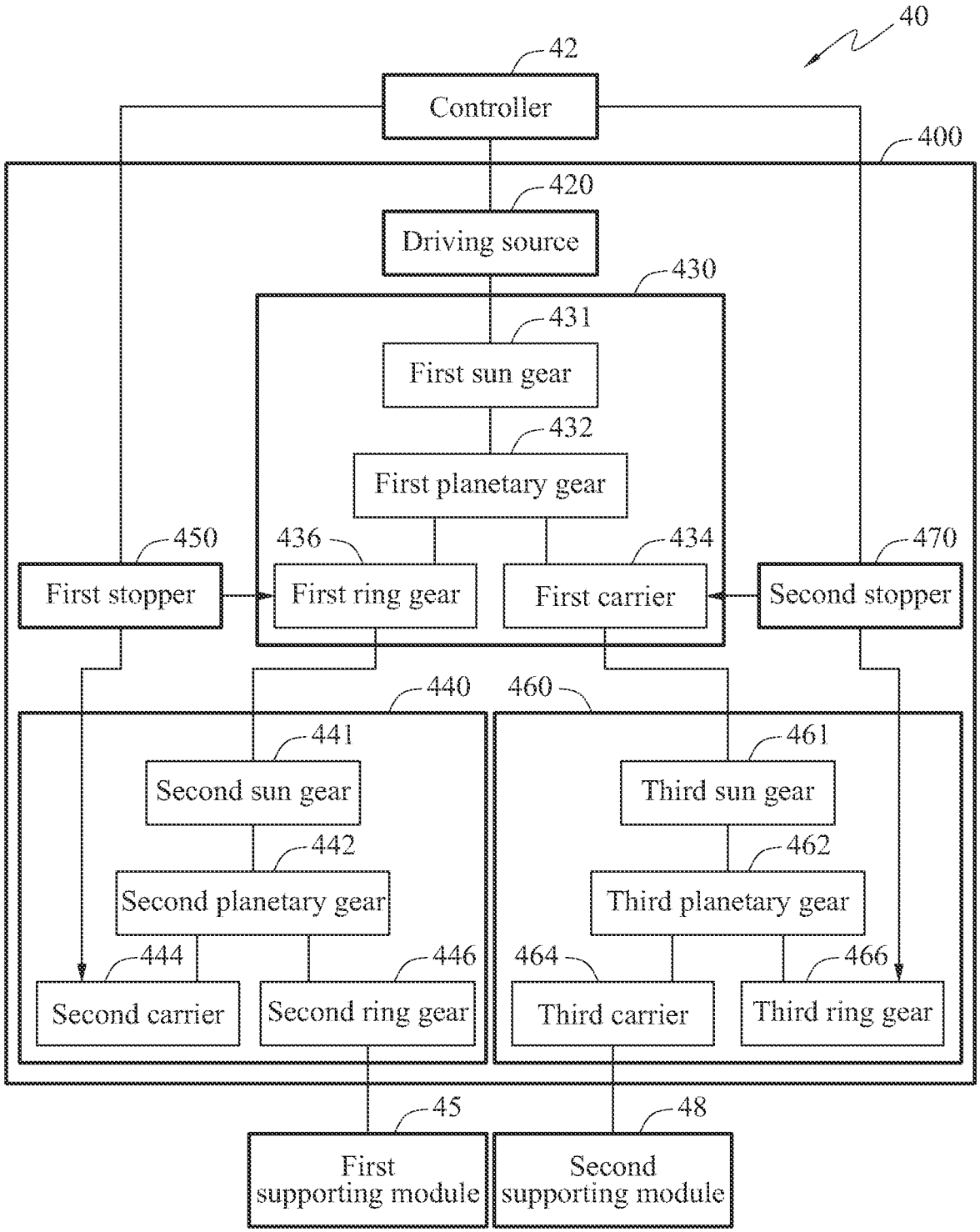
FIG. 11 is a block diagram illustrating a motion assistance apparatus according to an example embodiment.

FIG. 11 is a block diagram illustrating a motion assistance apparatus according to an example embodiment.

Referring to FIG. 11, a motion assistance apparatus 40 may include a controller 42, a driving module 400, a first supporting module 45, and a second supporting module 48.

The driving module 400 may include a driving source 420, a first decelerator 430, a second decelerator 440, a first stopper 450, a third decelerator 460, and a second stopper 470.

The first decelerator 430 may include a first sun gear 431, a first planetary gear 432, a first carrier 434, and a first ring gear 436.

The second decelerator 440 may include a second sun gear 441, a second planetary gear 442, a second carrier 444, and a second ring gear 446.

The first stopper 450 may include a first restrainer configured to selectively restrain the first ring gear 436, and a second restrainer configured to selectively restrain the second carrier 444. The first restrainer and the second restrainer may be provided in an integral body. In this example, the first stopper 450 may selectively restrain one of the first ring gear 436 and the second carrier 444.

The third decelerator 460 may include a third sun gear 461, a third planetary gear 462, a third carrier 464, and a third ring gear 466.

The second stopper 470 may include a third restrainer configured to selectively restrain the first carrier 434, and a fourth restrainer configured to selectively restrain the third ring gear 466. The third restrainer and the fourth restrainer may be provided integrally. In this example, the second stopper 470 may selectively restrain one of the first carrier 434 and the third ring gear 466.

The first supporting module 45 may be coupled to the second ring gear 446, and the second supporting module 48 may be coupled to the third carrier 464.

The motion assistance apparatus 40 may operate as shown in Table 4.

TABLE 4

| Motion State | | First Stopper | | Second Stopper | |
|---|---|---|---|---|---|
| | | First Ring Gear | Second Carrier | First Carrier | Third Ring Gear |
| Simultaneous Power Transmission (Level Walking) | | Release | Restraint | Release | Restraint |

TABLE 4-continued

| Motion State | | First Stopper | | Second Stopper | |
|---|---|---|---|---|---|
| | | First Ring Gear | Second Carrier | First Carrier | Third Ring Gear |
| Alternate Power Trans-mission (Slope Walking) | First Supporting Module Movement | Release | Restraint | Restraint | Release |
| | Second Supporting Module Movement | Restraint | Release | Release | Restraint |
| Power Blocking (Free Motion) | | Restraint | Release | Restraint | Release |

The foregoing example embodiments may be commonly described as follows.

A motion assistance apparatus according to example embodiments may include a controller, a driving module, a first supporting module, and a second supporting module.

The driving module may include a driving source, a first decelerator, a second decelerator, a first stopper, a third decelerator, and a second stopper. The first decelerator through the third decelerator may be 3-port decelerators respectively including a single input terminal and two output terminals.

The first decelerator may include a first input terminal, a first power transmitting rotary body, a first output terminal, and a second output terminal. The first power transmitting rotary body may transmit power received from the first input terminal to the first output terminal and the second output terminal. The first output terminal and the second output terminal may rotate at different angular velocities.

For example, similar to the example embodiments of FIGS. 1 through 5, the first input terminal, the first power transmitting rotary body, the first output terminal, and the second output terminal may correspond to the first sun gear 131, the first planetary gear 132, the first ring gear 136, and the first carrier 134, respectively.

The second decelerator may include a second input terminal, a second power transmitting rotary body, a third output terminal, and a fourth output terminal. The second power transmitting rotary body may transmit power received from the second input terminal to the third output terminal and the fourth output terminal. The first supporting module may be connected to one of the third output terminal and the fourth output terminal, for example, the fourth output terminal.

For example, similar to the example embodiments of FIGS. 1 through 5, the second input terminal, the second power transmitting rotary body, the third output terminal, and the fourth output terminal may correspond to the second sun gear 141, the second planetary gear 142, the second ring gear 146, and the second carrier 144, respectively.

The first stopper may include a first restrainer configured to selectively restrain the first output terminal, and a second restrainer configured to selectively restrain the third output terminal. The first restrainer and the second restrainer may be provided in an integral body. In this example, the first stopper may selectively restrain one of the first output terminal and the third output terminal.

The third decelerator may include a third input terminal, a third power transmitting rotary body, a fifth output terminal, and a sixth output terminal. The third power transmitting rotary body may transmit power received from the third input terminal to the fifth output terminal and the sixth output terminal. The second supporting module may be connected to one of the fifth output terminal and the sixth output terminal, for example, the fifth output terminal.

For example, similar to the example embodiments of FIGS. 1 through 5, the third input terminal, the third power transmitting rotary body, the fifth output terminal, and the sixth output terminal may correspond to the third sun gear 161, the third planetary gear 162, the third carrier 164, and the third ring gear 166, respectively.

The second stopper may include a third restrainer configured to selectively restrain the second output terminal, and a fourth restrainer configured to selectively restrain the sixth output terminal. The third restrainer and the fourth restrainer may be provided integrally. In this example, the second stopper may selectively restrain one of the second output terminal and the sixth output terminal.

The first supporting module may be connected to the fourth output terminal, and the second supporting module may be connected to the fifth output terminal.

For example, similar to the example embodiments of FIGS. 1 through 5, the first supporting module 15 may be connected to the second carrier 144, and the second supporting module 18 may be connected to the third carrier 164.

The motion assistance apparatus according to some example embodiments may operate as shown in Table 5.

TABLE 5

| Motion State | | First Stopper | | Second Stopper | |
|---|---|---|---|---|---|
| | | First Output Terminal | Third Output Terminal | Second Output Terminal | Sixth Output Terminal |
| Simultaneous Power Transmission (Level Walking) | | Release | Restraint | Release | Restraint |
| Alternate Power Transmission (Slope Walking) | First Supporting Module Movement | Release | Restraint | Restraint | Release |
| | Second Supporting Module Movement | Restraint | Release | Release | Restraint |
| Power Blocking (Free Motion) | | Restraint | Release | Restraint | Release |

The controller described in this disclosure may include a processor and a memory (not shown). The controller may be an arithmetic logic unit, a digital signal processor, a microcomputer, a field programmable array, a programmable logic unit, a microprocessor or any other device capable of responding to and executing instructions in a defined manner such that the controller is programmed with instructions that configure the processing device as a special purpose computer and is configured to control at least the driving module to transmit power to the first supporting module and the second supporting module of the motion assistance apparatus.

The instructions may be stored on a non-transitory computer readable medium. Examples of non-transitory computer-readable media include magnetic media such as hard disks, floppy disks, and magnetic tape; optical media such as CD ROM discs and DVDs; magneto-optical media such as optical discs; and hardware devices that are specially configured to store and perform program instructions, such as read-only memory (ROM), random access memory (RAM), flash memory, and the like. The non-transitory computer-readable media may also be a distributed network, so that the program instructions are stored and executed in a distributed fashion. The program instructions may be executed by one or more processors.

A number of example embodiments have been described above. Nevertheless, it should be understood that various modifications may be made to these example embodiments. For example, suitable results may be achieved if the described techniques are performed in a different order and/or if components in a described system, architecture, device, or circuit are combined in a different manner and/or replaced or supplemented by other components or their equivalents. Accordingly, other implementations are within the scope of the following claims.

What is claimed is:

1. A driving module comprising:

a driving source adapted to be on one side of a user, and configured to provide power;

a first decelerator including a first input terminal coupled to the driving source, and a first output terminal and a second output terminal configured to receive power from the first input terminal;

a second decelerator including a second input terminal coupled to the first output terminal, and a third output terminal and a fourth output terminal configured to receive power from the second input terminal; and a third decelerator including a third input terminal coupled to the second output terminal, and a fifth output terminal and a sixth output terminal configured to receive power from the third input terminal, wherein the first output terminal of the first decelerator is directly coupled to the second input terminal of the second decelerator such that the first output terminal transmits power to the second input terminal, and the second output terminal of the first decelerator is directly coupled to the third input terminal of the third decelerator such that the second output terminal transmits power to the third input terminal.

2. The driving module of claim 1, wherein the first decelerator further includes a first power transmitting rotary body configured to transmit power from the first input terminal to the first output terminal and the second output terminal, the second decelerator further includes a second power transmitting rotary body configured to transmit power from the second input terminal to the third output terminal and the fourth output terminal, and the third decelerator further includes a third power transmitting rotary body configured to transmit power from the third input terminal to the fifth output terminal and the sixth output terminal.

3. The driving module of claim 1, further comprising:

a first restrainer configured to selectively restrain the first output terminal;

a second restrainer configured to selectively restrain one of the third output terminal and the fourth output terminal;

a third restrainer configured to selectively restrain the second output terminal; and a fourth restrainer configured to selectively restrain one of the fifth output terminal and the sixth output terminal.

4. The driving module of claim 3, wherein the first restrainer and the second restrainer are provided in an integral body, and the third restrainer and the fourth restrainer are provided in an integral body.

5. The driving module of claim 1, further comprising:

a first stopper configured to selectively restrain one of the first output terminal and the third output terminal; and a second stopper configured to selectively restrain one of the second output terminal and the sixth output terminal.

6. The driving module of claim 1, wherein at least one of the first decelerator, the second decelerator, and the third decelerator is a planetary gear type using a sun gear as an input terminal thereof, and using a carrier and a ring gear as two output terminals thereof.

7. The driving module of claim 1, wherein the first decelerator is between the second decelerator and the third decelerator.

8. The driving module of claim 1, wherein the first, second, third decelerators are arranged in series in an order of the second decelerator, the first decelerator and the third decelerator.

9. A motion assistance apparatus comprising:

a fixing member to be attached to a user;

a driving module on one side of the fixing member, the driving module including a driving source, a first decelerator configured to receive power from the driving source, and a second decelerator and a third decelerator configured to receive power from the first decelerator;

a first joint member and a second joint member configured to assist rotary motions of a left portion and a right portion of the user, respectively;

a first power transmitting member between an output terminal of the second decelerator and the first joint member and configured to transmit power between the output terminal of the second decelerator and the first joint member; and a second power transmitting member between an output terminal of the third decelerator and the second joint member and configured to transmit power between the output terminal of the third decelerator and the second joint member.

10. The motion assistance apparatus of claim 9, wherein the first decelerator comprises:

a first input terminal configured to receive power from the driving source; and a first output terminal and a second output terminal configured to transmit power to the second decelerator and the third decelerator, respectively.

11. The motion assistance apparatus of claim 10, wherein the second decelerator comprises:

a second input terminal configured to receive power from the first output terminal; and two output terminals configured to receive power from the second input terminal, wherein the first power transmitting member is coupled to one of the two output terminals of the second decelerator.

12. The motion assistance apparatus of claim 11, further comprising:

a first restrainer configured to selectively restrain the first output terminal configured to transmit power to the second decelerator; and a second restrainer configured to selectively restrain, between the two output terminals of the second decelerator, an output terminal to which the first power transmitting member is not coupled.

13. The motion assistance apparatus of claim 9, further comprising:

a first stopper configured to selectively block power to be transmitted from the first decelerator to the second decelerator; and a second stopper configured to selectively block power to be transmitted from the first decelerator and the third decelerator.

14. The motion assistance apparatus of claim 9, wherein the first power transmitting member and the second power transmitting member are asymmetrically provided with respect to the driving module.

15. The motion assistance apparatus of claim 9, wherein the first decelerator is between the second decelerator and the third decelerator.

16. The motion assistance apparatus of claim 9, wherein the first, second, third decelerators are arranged in series in an order of the second decelerator, the first decelerator and the third decelerator.

17. A motion assistance apparatus comprising:

a fixing member to be attached to a user;

a driving module on one side of the fixing member, the driving module including a driving source, a first decelerator configured to receive power from the driving source, a second decelerator configured to receive power directly from a first output terminal of the first decelerator, and a third decelerator configured to receive power directly from a second output terminal of the first decelerator;

a first supporting member and a second supporting member configured to support one portion and another portion of the user, respectively;

a first power transmitting member between an output terminal of the second decelerator and the first supporting member and configured to transmit power between the output terminal of the second decelerator and the first supporting member; and a second power transmitting member between an output terminal of the third decelerator and the second supporting member and configured to transmit power between the output terminal of the third decelerator and the second supporting member.

18. The motion assistance apparatus of claim 17, wherein the first decelerator is between the second decelerator and the third decelerator.

19. The motion assistance apparatus of claim 17, wherein the first, second, third decelerators are arranged in series in an order of the second decelerator, the first decelerator and the third decelerator.

* * * * *